US007471272B2

(12) United States Patent
Oelhafen et al.

(10) Patent No.: US 7,471,272 B2
(45) Date of Patent: Dec. 30, 2008

(54) CONTROL METHOD AND DEVICE FOR A DISPLAY DEVICE

(75) Inventors: Patrick Oelhafen, Ottenbach (CH); Christopher Rodd Speirs, Zürich (CH); Marko Radovic, Wildberg (DE)

(73) Assignee: NXP B.V., Eindhoven (NL)

( * ) Notice: Subject to any disclaimer, the term of this patent is extended or adjusted under 35 U.S.C. 154(b) by 274 days.

(21) Appl. No.: 10/545,866

(22) PCT Filed: Jan. 30, 2004

(86) PCT No.: PCT/IB2004/000309

§ 371 (c)(1),
(2), (4) Date: Aug. 16, 2005

(87) PCT Pub. No.: WO2004/075157

PCT Pub. Date: Sep. 2, 2004

(65) Prior Publication Data

US 2006/0202988 A1 Sep. 14, 2006

(30) Foreign Application Priority Data

Feb. 19, 2003 (EP) ..... 03100379

(51) Int. Cl.
*G09G 3/36* (2006.01)

(52) U.S. Cl. ..... 345/87; 345/89; 345/690

(58) Field of Classification Search ..... 345/87–100, 345/422, 690–699
See application file for complete search history.

(56) References Cited

U.S. PATENT DOCUMENTS

| | | | | |
|---|---|---|---|---|
| 6,756,961 | B2 * | 6/2004 | Hector et al. | 345/98 |
| 2002/0135551 | A1 * | 9/2002 | Zeiter et al. | 345/87 |
| 2003/0112212 | A1 * | 6/2003 | Speirs | 345/95 |

FOREIGN PATENT DOCUMENTS

EP 1 318 500 6/2003

* cited by examiner

*Primary Examiner*—Vijay Shankar

(57) ABSTRACT

A display device (1) comprising: a liquid crystal display (2) having pixels (8) which are arranged in columns C and rows R; and a gate driving arrangement (4) for activating the pixels (8) of rows (R) in dependence on a row scanning scheme; a source driving arrangement (3) for providing column voltages representing the respective image data, a number of buffers (40) depending on the number of grey levels for supplying the respective voltage levels to the columns (C), a switching unit (31) for selecting a voltage level which corresponds to the grey level to be displayed; and a control unit (32) for controlling the buffers (40). For reducing the power consumption, an analyzing unit (39) is provided which analyzes the image data to be displayed such that the control unit (32) can determine the number of required buffers in dependence on the number of grey levels to be displayed and can switch off any unused buffers.

15 Claims, 2 Drawing Sheets

CONTROL METHOD AND DEVICE FOR A DISPLAY DEVICE

The present invention generally relates to a liquid crystal display having pixels which are arranged in columns and rows. In particular, the present invention relates to an LCD device with a gate driver arrangement for activating the pixels of rows in dependence on a row scanning scheme; and a source driver arrangement for providing columns voltages representing the respective image data, and a number of buffers for supplying the respective voltage level in dependence on the number of grey levels to be displayed, and a switching unit for combining the image data with the voltage level; and a control unit for controlling the buffers. The invention also relates to a method of driving a display device.

Liquid crystal display devices have a wide range of applications, i.e. for mobile phones, personal digital assistants, notebooks, or TV screens.

There are two kinds of displays, on the one hand passive matrix displays and on the other active matrix displays (AMLCD), which are also called TFT-displays. The present invention relates to TFT-displays, which are often used in portable appliances, so it is particularly important to realize a low power consumption. Many applications of display devices are battery operated, most being mobile phones. Battery lifetime is one of the key market drivers for such phones. If the power consumption of such a device can be reduced, the standby time can be increased. Alternatively, the battery capacity may be reduced giving a reduction in weight, another key factor.

An active matrix display (AMLCD) driving arrangement can be divided into a gate or row driver and a source or column driver, which two parts may be on a single chip or split up into two chips. The gate driver controls the gates of the thin film transistors (TFT) of the pixels by switching on or off all TFTs of a specific selected row. Each pixel of a display is composed of three sub-pixels presenting the colors red, green and blue by using filters. Each pixel has its own storage capacitor, which stores the charge on this pixel for one frame. When a specific row is activated or selected by the gate driver, the source driver provides to each sub-pixel of this row the required column voltage, corresponding to the grey level to be displayed of the respective sub-pixel. The human eye makes a mixture of the grey levels of the sub-pixels to obtain the final color. When the scanning scheme continues with the following row, the previous row is deactivated by switching-off of the gates of the TFTs in that row and the charge value is kept by the storage capacitor.

To generate grey levels, a resistor chain may be used which divides the supply voltage into several partial voltages. Each partial voltage is buffered by a buffer to generate voltage levels. There are as many partial voltages and buffers as grey levels are required. These several voltage levels are supplied to a switching unit. The image data are also supplied to the switching unit. The switching unit selects a voltage level, which corresponds to the grey level to be displayed. Thus the column voltage is generated, which is supplied to the respective column output pad of the display. The source driver supplies a respective column voltage to each column. The number of different column voltages depends on the number of grey levels to be displayed.

It is known to change the amount of colors for certain operational modes. Thus only a few colors are driven or a black and white mode is used in the standby mode, but in the video mode all possible grey levels are driven to display all possible colors.

It is accordingly an object of the invention to provide a display device having a further reduced power consumption, especially a power consumption which can be reduced independently of the operational mode used.

This object is achieved by the features of claim 1.

The invention is based on the idea that most displays can be operated in different modes. The driving arrangement for providing the required column and row voltages is capable of driving each mode, such that parts of the driving arrangement are only needed for a certain mode. This causes an unnecessary power consumption in the respective unused parts. This means that not all buffers are required for driving only a small amount of colors in certain modes. By analyzing the number of grey levels in the image data to be displayed it is possible to drive only the required buffers and to switch off all unused buffers. Especially mobile phones are mostly used in a still picture mode or a standby mode, because no video mode is required for occasional phoning. The mobile phone, however, should be capable of displaying videos. The use of the invention can save a large amount of power.

To achieve this, a control unit is arranged in the source driver, which unit analyses the supplied image data. Depending on the grey levels which should be displayed, the number of buffers is determined by the control unit. The unused buffers are switched off by the control unit.

One aspect of the present invention leads to an embodiment having a memory unit incorporated in the source driver. It is advantageous especially for a still picture mode and a standby mode to avoid a constant transmission of image data for pictures which are not constantly changing. These image data can be stored in the memory unit.

In the video mode, the picture to be displayed is constantly changing, so it makes no sense to store the image data in the memory unit, because the memory has to be written and read out at least as much as the picture changes. In this video mode the memory unit is bypassed and the data are directly transmitted through an interface from an external storage medium, a recording or playback-device.

Another aspect of the present invention results in a display device, in which the control unit is provided for analyzing the memory content when the memory is written, the number of required buffers is determined in dependence on the grey levels contained in the written image data, and the buffers not required are switched off by the control unit. The memory is only rewritten if the image data has changed, so in the meantime there is no change of the grey levels to be displayed. Therefore, only the buffers for driving the voltage levels for these used grey levels are switched on. The remaining buffers are switched off by the control unit until the memory is rewritten. The image data are analyzed before they are written in the memory, which can be performed very easily, because the control unit controls the writing process to the memory. So the image data can be analyzed before they are supplied to the memory.

This embodiment has the advantage that the additional routing effort is very small. The analyzing part in the control unit does not need extra space, because the analysis can be done by existing circuitry.

A further aspect of the present invention yields a display device wherein the control unit is provided for analyzing the memory content when the memory unit is read out, the number of required buffers is determined in dependence on the grey levels of the read out image data to be displayed, and the buffers not required are switched off by the control unit. In this embodiment the image data are analyzed after they have been stored in the memory. So there has to be a feedback line from the memory output to the control unit. This has the advantage that there is more time for analyzing the image data, because the analysis can be done while the picture is being displayed.

A further embodiment of the present invention relates to a display device having feedback lines between the buffers and the control unit. After a first frame of rows has been scanned, it can thus be checked which buffers have supplied a current to the switching unit. If the buffer has not supplied a current to the switching unit, it was not used, which means the grey level which corresponds to that voltage level, which is driven by that buffer, was not contained in the image data. So this buffer can be switched off. All unused buffers remain switched off until the respective memory content changes.

The ON/OFF switching of the buffers is realized in all cases in that control lines are provided between the buffers and the control unit.

In a further embodiment, the on/off switching of the buffers can be linked to the used operational mode, i.e. the on/off switching of buffers is only possible in the standby or in the still picture mode.

The object of that invention is also solved by a method of driving a display device having pixels arranged in columns and rows, comprising the following steps: the number of used grey levels for the image to be displayed is analyzed; the number of buffers for providing the column voltages is determined in dependence on the number of grey levels used, and the unused buffers are switched off.

In order that the invention may be well understood, some embodiments thereof will now be described by way of example, reference being made to the accompanying drawings, in which.

Figure 1:
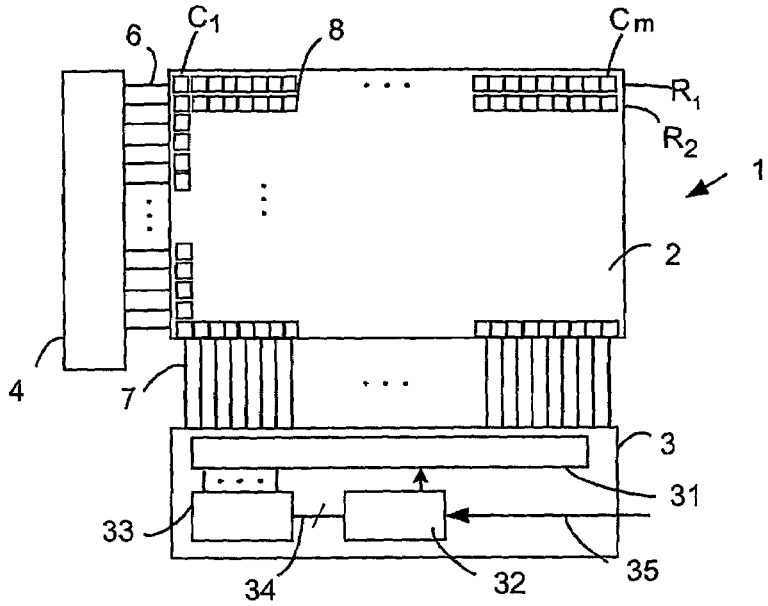
FIG. 1 shows a block diagram of a display device according to the present invention.

FIG. 1 shows block diagram of a display device according to the invention. The display device 1 comprises an LCD panel 2 having n rows R and m columns C. A gate driving arrangement 4 provides the respective row or selection voltages over the gate lines 6 in dependence on a scanning scheme. The source driving arrangement 3 provides the column voltages to the columns C of the LCD panel 2 over the source lines 7. The source driver 3 comprises a voltage generation unit 33 in which the required voltages levels are generated. These voltage levels are provided to a switching unit 31. The source driver 3 further comprises a control unit 32 which receives the image data via line 35. The image data are provided by a device (not shown), for example a graphic controller or the like. The control unit 32 is connected to the voltage generation unit 33 for controlling it. Furthermore, it is arranged for providing the image data to the switching unit 31. In the switching unit 31 the voltage levels are assigned to the supplied image data for providing the respective column voltages to the columns C. The control unit 31 analyzes the supplied image data and determines the number of grey levels in the image data to be displayed. The control unit 32 is able to switch off all unused buffers in the voltage generation unit 33 on the basis of the information how many and which grey levels are required for showing the image data on the LCD-panel 2. A large amount of power can be saved in this manner.

Figure 2:
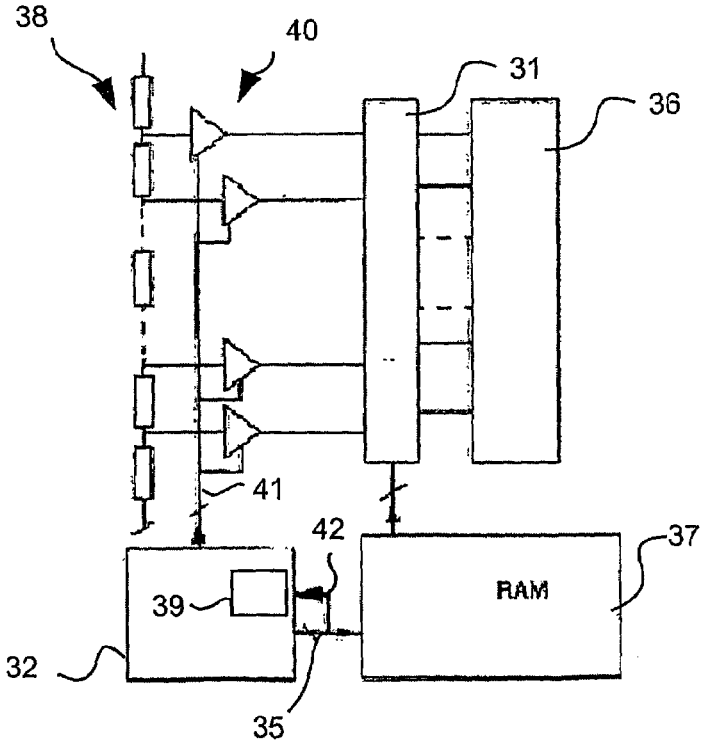
FIG. 2 shows a block diagram of a display device, where the image data are analyzed before being written into the memory according to the present invention.

FIG. 2 shows a block diagram of a display device 1, where the image data are analyzed before being written into the memory unit 37 according to the present invention. The voltage generation unit is comprised of a resistor chain 38 and buffers 40, which operate as follows. The partial voltages may also be generated by a capacitor divider. The generated voltage levels are supplied to a switching unit 31. The control unit 32 contains an analyzing unit 39. In this embodiment a memory unit 37 is arranged for storing the image data until the image is changing. The image data is supplied to the control unit 32 and the control unit 32 transmits the image data to the memory unit 37. Each time the memory unit 37 is written, the analyzing unit 39 analyzes the image data 35, which are written into the memory unit 37 via a feedback line 42. The stored image data in the memory unit 37 are supplied to the switching unit 31, which selects for each column C the respective voltage level corresponding to the image data. In this way the column voltages are generated and supplied to the column output pads 36, which are connected to the column line 7 of the LCD panel 2. By analyzing the image data before they are written into the memory, the analyzing unit determines the number of required buffers. The buffers for grey levels which are not included in the image data are switched off by the control unit 32 via the switching lines 41. They remain switched off until the memory unit 37 is rewritten.

Figure 3:
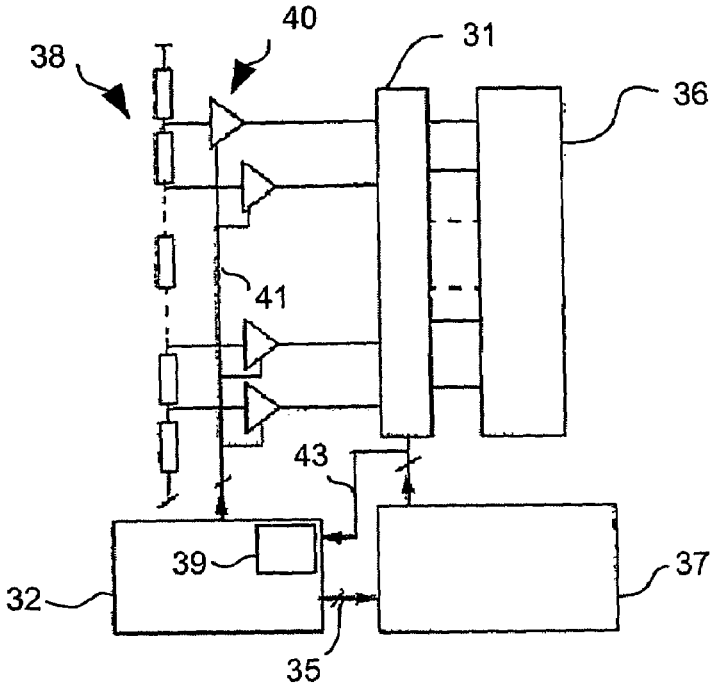
FIG. 3 shows a block diagram of a display device, where the image data are analyzed after reading out of the memory according to the present invention.

FIG. 3 shows a block diagram of a display device 1, where the image data are analyzed after reading out of the memory unit 37 according to the present invention. There is a feedback line 43 coupled from the output of the memory unit 37 to the analyzing unit in the control unit. The control unit 32 switches off all buffers 40 that are not required. The unused buffers remain switched off until the image data change.

Figure 4:
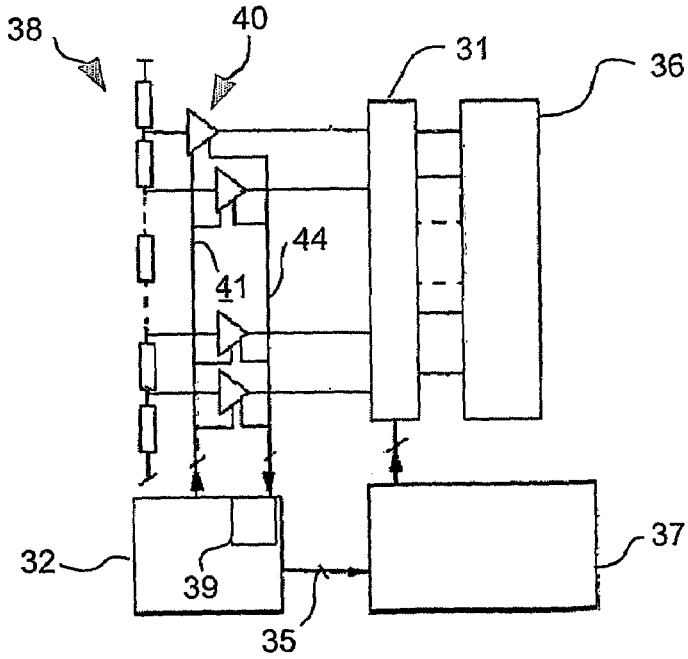
FIG. 4 shows a block diagram of a display device, where the buffers are analyzed after a first scan of the rows according to the present invention.

FIG. 4 shows a block diagram of a display device 1, where the buffers are analyzed after a first scan of the rows R according to the present invention. Each buffer has a feedback line 44 coupled to the control unit. After a first frame of rows has been scanned, the analyzing unit 39 analyzes whether the buffer has supplied a signal, i.e. current, to the switching unit 31. If a buffer 40 has not supplied a signal, the respective buffer was not used and may therefore be switched off via the respective switching line 41.

The analyzing unit 39 may be realized as a counter, which counts the coded grey levels contained in the image data. The counter may be realized with existing circuitry in the control unit 31.

In the following an example will be explained. An LCD module of a mobile phone is capable of showing e.g. 4000 colors, i.e. 32 buffers are required. As long as the mobile is in the standby or the still picture mode, only the network provider is displayed or information from the address book or the telephone number of an incoming call, etc. This means that only a small amount of colors is needed, which requires a smaller number of buffers, so the rest of the buffers can be switched off. The number of colors needed will be analyzed within the control unit 32 during the writing process or the read out process or after the first scan of rows with the feedback lines 44.

The invention claimed is:

1. A display device comprising:

a liquid crystal display shaving pixels which are arranged in columns and rows;

a gate driving arrangement for activating the pixels of rows in dependence on a row scanning scheme;

a source driving arrangement for providing column voltages representing image data, the source driving arrangement has a memory unit for storing the image data;

a number of buffers depending on the number of grey levels for supplying the respective voltage levels to the columns;

a switching unit for selecting a voltage level which corresponds to the grey level to be displayed; and a control unit connected to the buffers to control the buffers, wherein each buffer is also connected to the control unit via a feedback line to send a feedback signal from the buffer to the control unit, indicating whether that buffer has delivered a drive signal to drive a certain grey level, and wherein the control unit is configured to analyze feedback signals from the buffers during a scan of the rows, said control unit being further configured to switch off each of the buffers that has not delivered a drive signal.

2. A display device comprising:

a liquid crystal display having pixels which are arranged in columns and rows a gate driving arrangement for activating the pixels of rows in dependence on a row scanning scheme;

a source driving arrangement for providing column voltages representing image data;

a plurality of buffers depending on the number of grey levels for supplying the respective voltage levels to the columns;

a switching unit for selecting a voltage level which corresponds to the grey level to be displayed; and a control unit configured to analyze the image data to determine the number of grey levels included in the image data and to determine required buffers of the plurality of buffers for the number of grey levels to be displayed, the control unit being also connected to the buffers to control the buffers, the control unit being configured to switch off unused buffers of the plurality of buffers that are not needed to display the number of grey levels included in the image data.

3. The display device as claimed in claim 2, wherein the source driving arrangement comprises a memory unit for storing the image data, said the control unit controlling the memory unit.

4. The display device as claimed in claim 3, wherein the control unit is configured to analyze the image data when the image data is written into the memory unit.

5. The display device as claimed in claim 3, wherein the control unit is configured to analyze the image data when the image data is readout form the memory unit.

6. The display device as claimed in claim 2, wherein a feedback line between each buffer and the control unit is provided for sending a feedback from the buffer to the control unit, indicating whether the respective buffer has delivered a signal for driving a certain grey level, and wherein the control unit is provided for analyzing the feedback signals of the buffers during a whole frame and for switching off the buffers that are not required.

7. The display device as claimed in claim 2, wherein each buffer is connected to the control unit by a switching line.

8. The display device as claimed claim 2, wherein the control unit comprises an analyzing unit for counting the used grey levels and for determining the required buffers.

9. The display device as claimed in claim 2, wherein the unused buffers are switched off until the memory unit is rewritten or the image to be displayed has changed.

10. The display device as claimed in claim 2, wherein the buffers are connected to the supply voltage via a resistor chain.

11. The display device as claimed in claim 2, wherein the buffers are switched off in dependence on an operational mode used for displaying the image data.

12. A method of driving a display device having pixels arranged in columns and rows, comprising:

analyzing image data to be displayed on a liquid crystal display to determine the number of grey levels included in the image data;

determining required buffers of a plurality of buffers to provide column voltages to the columns for the determined number of grey levels; and switching off unused buffers of the plurality of buffers that are not needed to display the number of grey levels included in the image data.

13. A method as claimed in claim 12, wherein the number of grey levels used for the image data to be displayed is analyzed each time a memory unit containing the image data is written.

14. A method as claimed in claim 12, wherein the number of grey levels used for the image data to be displayed is analyzed each time a memory unit containing the image data is read out.

15. A method as claimed in claim 12, wherein the number of grey levels used for the image data to be displayed is analyzed by feeding back a feedback signal from the buffers, indicating whether the respective buffer has delivered a signal for driving a certain grey level, after scanning of a whole frame, whereupon any unused buffers are switched off.

* * * * *